US007766613B2

(12) United States Patent
Fukuki

(10) Patent No.: US 7,766,613 B2
(45) Date of Patent: Aug. 3, 2010

(54) PUMP AND LIQUID SUPPLY SYSTEM

(75) Inventor: Harumi Fukuki, Kasuga (JP)

(73) Assignee: Matsushita Electric Works, Ltd., Osaka (JP)

( * ) Notice: Subject to any disclaimer, the term of this patent is extended or adjusted under 35 U.S.C. 154(b) by 691 days.

(21) Appl. No.: 11/798,968

(22) Filed: May 18, 2007

(65) Prior Publication Data

US 2007/0274828 A1 Nov. 29, 2007

(30) Foreign Application Priority Data

May 24, 2006 (JP) ..... 2006-144398

(51) Int. Cl.
*F04D 1/06* (2006.01)

(52) U.S. Cl. ..... 415/199.2; 415/206; 415/211.2; 415/191

(58) Field of Classification Search ..... 415/199.1, 415/199.2, 199.3, 206, 211.2, 191; 417/423.5
See application file for complete search history.

(56) References Cited

U.S. PATENT DOCUMENTS 2,748,713 A * 6/1956 Buchi ..... 415/187
3,730,641 A * 5/1973 Gordon ..... 415/199.3
5,344,285 A * 9/1994 O'Sullivan et al. ..... 415/199.2
6,481,961 B1 * 11/2002 Pai ..... 415/199.2

* cited by examiner

*Primary Examiner*—Ninh H Nguyen
(74) *Attorney, Agent, or Firm*—Bacon & Thomas, PLLC

(57) ABSTRACT

A pump includes a pump unit, a pump case, a motor unit, a plurality of guide blades forming plural guide paths in tangent directions of the impellers; and a multiplicity of return blades to form paths for collecting the liquid under pressure from the guide paths into a suction opening of a next-stage impeller. The return blades have a configuration in which a total cross sectional area of inlet openings of concave paths formed by a plurality of ribs is set to be equal to or larger than a cross sectional area of the suction port, while a total volume of the concave paths is set to be smaller than the total volume of non-path portions excluding the paths.

4 Claims, 5 Drawing Sheets

PUMP AND LIQUID SUPPLY SYSTEM

FIELD OF THE INVENTION

The present invention relates to a pump driven by a motor to suck and discharge liquid, and a liquid supply system having the pump.

BACKGROUND OF THE INVENTION

In recent years, there has been an increasing market demand for a compact high-lift pump having a small liquid volume. A conventional centrifugal pump has a configuration in which impellers are disposed in multiple stages on a single shaft in order to achieve a high-lift property of the pump without having to increase an outer diameter of the pump. In this configuration, liquid is sequentially energized by the multi-stage impellers to be lifted to a high level.

A vertical multi-stage centrifugal pump includes impellers disposed vertically in multiple stages, where each of the impellers has discharge openings at its peripheral surface, and a suction opening at a bottom side thereof. FIGS. 5A to 5C illustrate an exemplary configuration of such an impeller. As shown in FIGS. 5A to 5C, the impeller has, along its circumference, a plurality of guide blades 127 for forming guide paths in tangential direction and a multiplicity of return blades 128 for forming return paths to collect liquid under pressure from the guide paths to a suction opening 137 of a next-stage impeller. The return blades 128 are radially provided between the impellers in multiple stages.

The return blades 128 are implemented by a multiplicity of thin ribs 132. The total volume of concave paths 133 formed between the ribs 132 is set to be larger than the total volume of non-path portions (ribs) of the whole region forming the paths (see, for example, Japanese Patent Laid-open Application No. 2003-184778). That is, defining the total volume of the flow paths to be V1 and the total volume of the non-path portions to be V2, V1 is larger than V2 (V1>V2).

However, the technique disclosed in Japanese Patent Laid-open Application No. 2003-184778 is mostly applied to a pump with a high liquid volume having a comparatively large suction port and discharge port. In case the technique is applied to a compact high-lift pump with a low liquid volume having a small suction port and discharge port, i.e., when it is applied to a pump having a low specific rate, the cross sectional areas of the paths of the guide blades and the return blades would become greater than the cross sectional area of the suction port to make the flow paths suddenly expanded, which would cause an increase of a liquid loss.

SUMMARY OF THE INVENTION

It is, therefore, an object of the present invention to provide a highly efficient high-lift pump having a low liquid volume and a low liquid loss wherein there is avoided a sudden expansion of a flow path from an upstream side toward a downstream side of return blades in a pump having a low specific rate, thus allowing a smooth liquid flow; and also to provide a liquid supply system using the pump.

In accordance with an embodiment of the present invention, there is provided a pump including a pump unit including at least two impellers for sucking and discharging a liquid, the impellers being disposed in multiple stages; a pump case accommodating the pump unit and provided with a suction port and a discharge port for the liquid; a motor unit for driving the pump unit; a plurality of guide blades forming plural guide paths in tangent directions of the impellers; and a multiplicity of return blades radially disposed between the impellers to form paths for collecting the liquid under pressure from the guide paths into a suction opening of a next-stage impeller, wherein the return blades have a configuration in which a total cross sectional area of inlet openings of concave paths formed by a plurality of ribs is set to be equal to or larger than a cross sectional area of the suction port, while a total volume of the concave paths is set to be smaller than the total volume of non-path portions excluding the paths.

With such arrangements, a sudden expansion of the flow paths from the upstream toward the downstream of the return blades can be avoided in the pump having a low specific rate, thereby achieving a smooth liquid flow.

In accordance with the present invention, it is possible to provide a highly efficient high-lift pump having a small liquid volume, which suffers little fluid loss by the return blades, and a liquid supply system having the above pump.

In the embodiments of the present invention, a pump includes a pump unit including at least two impellers for sucking and discharging a liquid, the impellers being disposed in multiple stages; a pump case accommodating the pump unit and provided with a suction port and a discharge port for the liquid; a motor unit for driving the pump unit; a plurality of guide blades forming plural guide paths in tangent directions of the impellers; and a multiplicity of return blades radially disposed between the impellers to form paths for collecting the liquid under pressure from the guide paths into a suction opening of a next-stage impeller, wherein the return blades have a configuration in which a total cross sectional area of inlet openings of concave paths formed by a plurality of ribs is set to be equal to or larger than a cross sectional area of the suction port, while a total volume of the concave paths is set to be smaller than the total volume of non-path portions excluding the paths. That is, when defining the total cross section of the inlet openings 34 of the concave paths 33 to be S1; the cross section S2 of the suction port 11 to be S2; the total volume of the concave flow paths 33 to be V1 and the total volume of the convex non-path portions 35 to be V1, it is set up so that S1≧S2 or V1≦V2.

With such arrangements, a sudden expansion of the flow paths from the upstream toward the downstream of the return blades can be avoided in the pump having a low specific rate, thereby achieving a smooth liquid flow. Accordingly, it is possible to provide a highly efficient high-lift pump having a small liquid volume, which suffers little fluid loss by the return blades.

Further, center-side leading ends of the return blades may be adjoined to the suction opening of the next-stage impeller.

With such a configuration, a vortex current is created when liquid flows into the suction opening of the next-stage impeller.

Further, by enclosing the above pump into the liquid supply system including the cooling device for electronic components and the like, the usability for the liquid supply system can be enhanced greatly.

BRIEF DESCRIPTION OF THE DRAWINGS

The above and other objects and features of the present invention will become apparent from the following description of embodiments given in conjunction with the accompanying drawings, in which:

FIGS. 3A to 3C illustrate return blades and guide blades in accordance with the first and the second embodiment of the present invention wherein FIG. 3A is a plan view of the guide blades; FIG. 3B is a cross sectional view of the guide blades and the return blades; and FIG. 3C is a plan view of the return blades;

FIG. 5A is a plan view of the guide blades, FIG. 5B is a cross sectional view of the guide blades and the return blades, and FIG. 5C is a plan view of the return blades.

DETAILED DESCRIPTION OF THE EMBODIMENTS

Hereinafter, embodiments of the present invention will be described in detail with reference to the accompanying drawings.

First Embodiment

Figure 1:
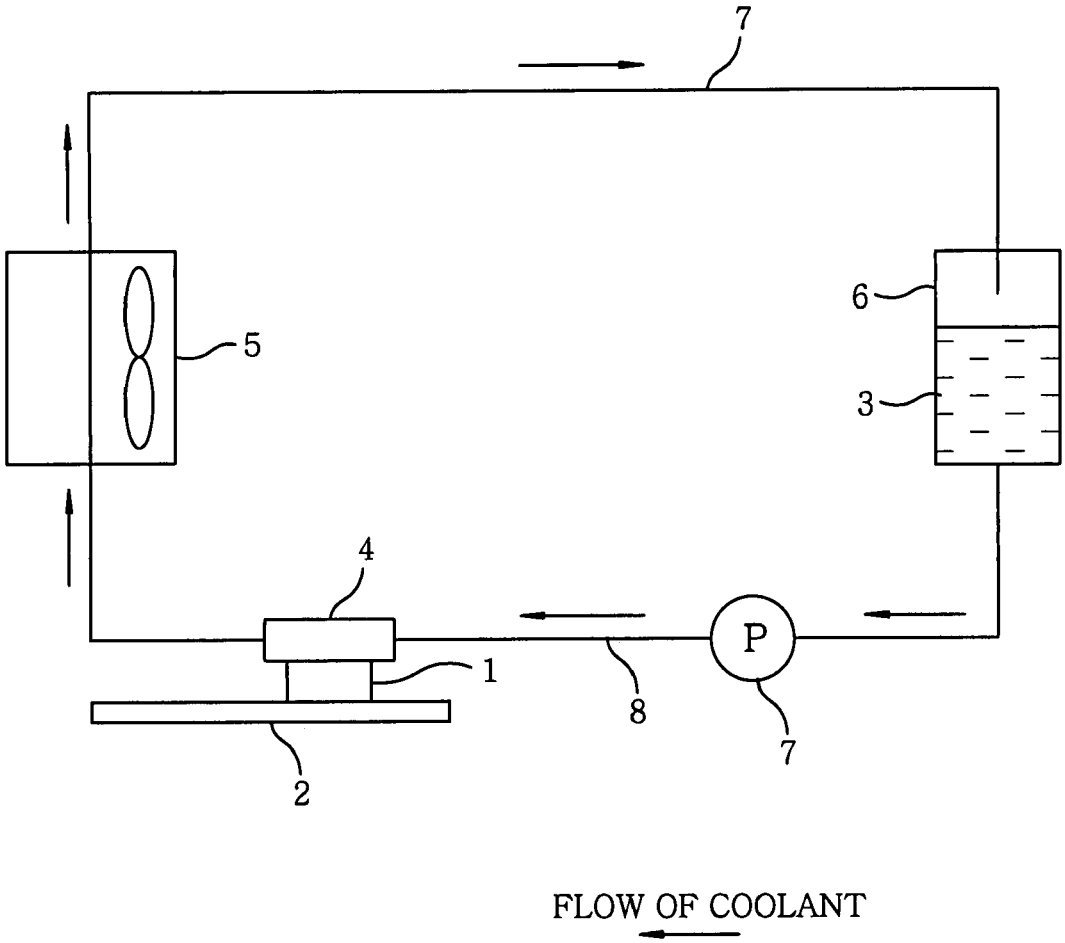
FIG. 1 is a schematic view of a cooling device for electronic components in accordance with a first and a second embodiment of the present invention.

A system shown in FIG. 1 includes a heating element 1 mounted on a substrate 2 and a cooling device 4 for cooling the heating element 1 by transferring heat from the heating element 1 to a coolant 3.

The system further includes a radiator 5 for removing heat from the coolant 3; a reserve tank 6 for storing the coolant 3 therein; a pump for circulating the coolant 3; and a pipeline 8 for connecting the cooling device 4, the radiator 5, the reserve tank 6 and the pump 7.

Figure 2:
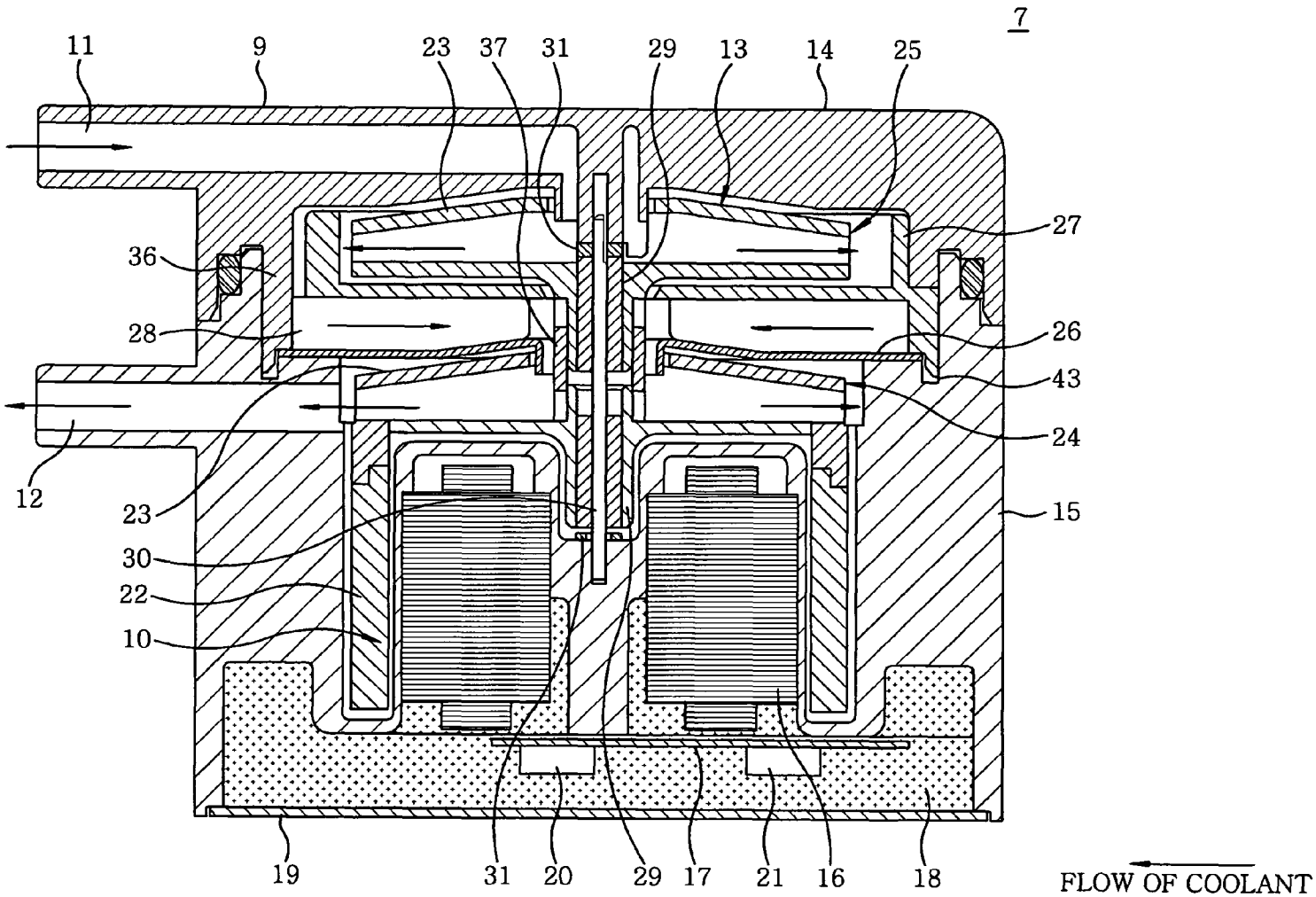
FIG. 2 provides a cross sectional view of a pump in accordance with the first and the second embodiment of the present invention.

As shown in FIG. 2, the pump 7 has a pump case 14 disposed at an upper side of a pump main body 9, wherein the pump case 14 is made of plastic such as PPS (polyphenylene sulfide), a metal such as stainless steel, or the like and is provided with a suction port 11 and a discharge port 12. Further, the pump case 14 encloses a pump unit 13 for suctioning or discharging the coolant 3 in the reserve tank 6.

Disposed under the pump case 14 is a waterproof partition wall 15 which accommodates a motor unit 10 for driving the pump 7. The waterproof partition wall 15 isolates the motor unit 10 from the pump unit 13 and thus prevents the coolant 3 from flowing out of the pump unit 13 and into the motor unit 10. The waterproof partition wall 15 is made of a metal such as aluminum, a heat resistant plastic, or the like.

The motor unit 10 has a cylindrical stator 16 for generating a magnetic field, a controller 17 for controlling the stator 16, a hardened resin 18 injected to protect the stator 16 and the controller 17, and a lid 19 for preventing an exposure of the resin 18. The stator 16 is installed in an inner recess portion of the partition wall 15.

The controller 17 is disposed under the stator 16, and it has electronic components 20 and 21 such as transformers or transistors.

Meanwhile, the pump unit 13 has a cylindrical rotor 22 which is made up of permanent magnets or the like and is driven by the magnetic field generated by the stator 16, thereby rotating. The pump unit 13 also has a plurality of blades 23 integrally attached on the surface of the rotor 22.

In this embodiment, cylindrical impellers 24 and 25 made of plastic such as PPS are vertically disposed in two stages at the discharge port side and the suction port side, respectively. The impellers 25 and 24 respectively serve to suck and discharge the coolant 3 from and to the reserve tank 6 by using the plurality of blades 23.

A disk-shaped partition plate 26 made of a metal such as a stainless steel is disposed between the impeller 24 on the discharge port side (hereinafter simply referred to as discharge-side impeller 24) and the impeller 25 on the suction port side (hereinafter, simply referred to as suction-side impeller 25) to isolate them from each other. Also disposed between the impellers 24 and 25 are guide blades 27 and return blades 28 made of, e.g., plastic such as PPS, for guiding liquid that has been discharged out of the suction-side impeller 25 in the peripheral direction, into a central suction opening of the discharge-side impeller 24.

Bearings 29 made of thermocarbon or mold carbon are attached at the centers of the rotation axes of the impellers 24 and 25, and a columnar shaft 30 made of a metal such as stainless steel is inserted through the bearings 29 to support the impellers 24 and 25, while allowing their rotation. Hollow disk-shaped bearing plates 31 made of, e.g., ceramic are attached to both end portions of the shaft 30, and the bearing plate 31 slidably contact with the bearings 29.

The rotor 22 is installed to face the stator 16 with the partition wall 15 interposed therebetween.

Figure 3A:
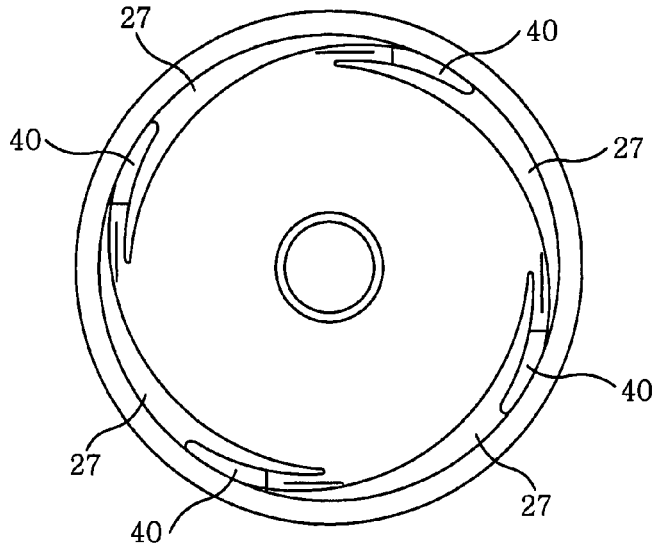
Figure 3B:
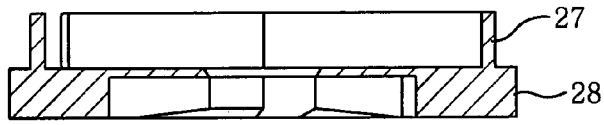
Figure 3C:
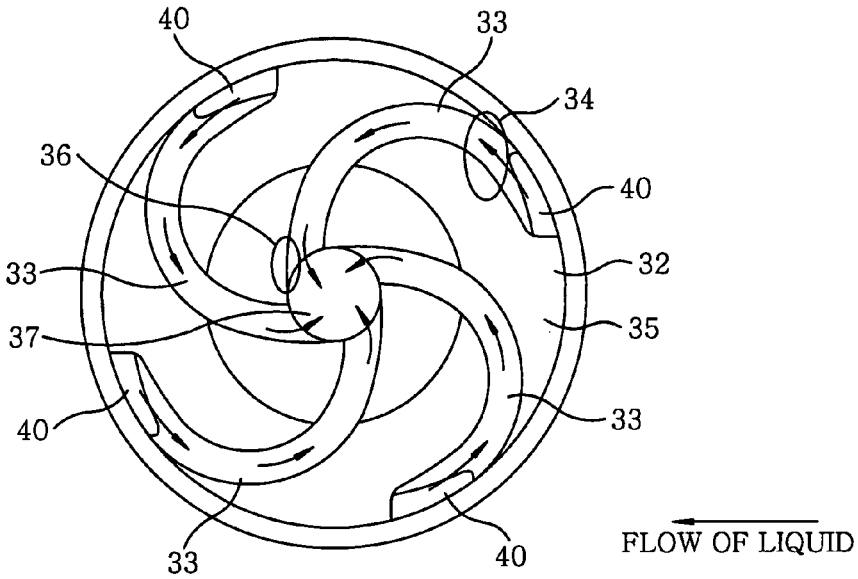

Referring to FIGS. 3B and 3C, the return blades 28 are made of a plurality of thick ribs 32 which are disposed in the space between the suction-side impeller 25 and the partition plate 26, while forming concave paths 33 for liquid. Here, the total cross sectional area of inlet openings 34 of the concave paths 33 is set to be equal to or larger than the cross sectional area of the suction port 11 of the pump case 14, while the total volume of the concave paths 33 is set to be smaller than the total volume of convex non-path portions 35 (portions excluding the concave flow paths 33).

That is, when defining the total cross section of the inlet openings 34 of the concave paths 33 to be S1; the cross section S2 of the suction port 11 to be S2; the total volume of the concave flow paths 33 to be V1 and the total volume of the convex non-path portions 35 to be V1, it is set up so that $S1 \geqq S2$ or $V1 \leqq V2$.

In accordance with the first embodiment of the present invention, in a compact high-lift pump having a small liquid volume and a specific rate of 50 or less by providing four guide blades 27 and four concave paths of the return blades 28, a condition in which $S1=5 \cdot S2>S$ and $V1=4/5 \cdot V2<V2$ is achieved.

Accordingly, in the pump having the low specific rate, it is possible to avoid a sudden expansion of the flow paths from the upstream side toward the downstream side of the return blades, thereby allowing a smooth liquid flow.

Hereinafter, operations of the pump and the cooling device having the pump in accordance with the first embodiment will be described with reference to FIGS. 1 to 3C.

If the stator 16 of the pump 7 is operated to generate a magnetic field under the control of the controller 17, the rotor 22 is rotated by the magnetic field. If the rotor 22 is rotated, the discharge-side impeller 24 and the suction-side impeller 25 integrated with the rotor 22 are also rotated, thereby driving the pump 7.

If the pump 7 is operated, the coolant 3 is introduced into the pipeline 8 through an outlet port provided at a lower portion of the reserve tank 6 and flows in the pipeline 8 to be sucked into the suction-side impeller 25 within the pump 7 via the suction port 11 provided at an upper side surface of the pump 7.

The suctioned coolant 3 is flown in peripheral direction by the plurality of blades 23 formed on the surface of the suction-side impeller 25 in rotation. Then, the coolant 3 is directed into cut-out portions 40 by the guide blades 27 and then flown from the cut-out portions 40 into a suction chamber of the discharge-side impeller 24 defined by the guide blades 27 by the partition plate 26. Here, the coolant 3 is directed into the central suction opening of the discharge-side impeller 24 by being guided the return blades 28 that are provided on the discharge side of the return blades 27 to be sucked by the discharge-side impeller 24.

Then, the sucked coolant 3 is sent in the peripheral direction by the plurality of blades 23 formed on the surface of the discharge-side impeller 24 and is discharged out of the pump 7 via the discharge port 12 provided at a side surface of the pump 7.

The discharged coolant 3 is flown into the cooling device 4 via the pipeline 8 connected to the discharge port 12. In the cooling device 4, heat is transferred from the heating element 1 to the coolant 3, whereby the temperature of the coolant 3 is increased. Then, the coolant is sent to the radiator 5 to be cooled. The coolant whose temperature is lowered by the radiator 5 is then returned to the reserve tank 6.

By employing the above-described system, it is possible to cool the heating element 1 by circulating the coolant 3 with the pump 7.

In accordance with the first embodiment of the present invention, the return blades 28 form the concave paths 33 with the plurality of thick ribs 32 in the space between the suction-side impeller 25 and the partition plate 26, and the total cross sectional area of the inlet openings 34 of the concave paths 33 is set to be equal to or larger than the cross sectional area of the suction port 11, while the total volume of the concave paths 33 is set to be smaller than the total volume of convex non-path portions 35. With this configuration, a sudden expansion of the flow paths from the upstream side toward the downstream side of the return blades 28 can be avoided, thereby allowing a smooth liquid flow. Accordingly, in accordance with the first embodiment, it is possible to provide a highly efficient high-lift pump having a small liquid volume, which suffers little fluid loss by the return blades 28.

Second Embodiment

In a second embodiment, parts and elements having the same configurations and functions as those described in the first embodiment will be assigned like reference numerals and redundant descriptions thereof will be omitted.

The second embodiment is different from the first embodiment in that center-side leading ends 36 (see FIG. 3C) of return blades 28 are adjoined to a suction opening 37 of a next-stage impeller 24.

With such a configuration, a vortex current is created when liquid flows into the suction opening 37 of the next-stage impeller 24.

Now, operations of a pump and a cooling device using the pump in accordance with the second embodiment will be explained with reference to FIGS. 1 to 3C.

If a stator 16 of a pump 7 is operated to generate a magnetic field under the control of a controller 17, a rotor 22 is rotated by the magnetic field. If the rotor 22 is rotated, a discharge-side impeller 24 and a suction-side impeller 25 integrated with the rotor 22 are also rotated, whereby the pump 7 is finally driven.

If the pump 7 is operated, a coolant 3 is introduced into a pipeline 8 through a outlet port provided at a lower portion of a reserve tank 6 and flows in the pipeline 8 to be finally suctioned into the suction-side impeller 25 within the pump 7 via a suction port 11 provided at an upper side surface of the pump 7.

The suctioned coolant 3 is flown in peripheral direction by a plurality of blades 23 formed on the surface of the suction-side impeller 25 which is rotating. Then, the coolant 3 is directed into cut-out portions 40 by guide blades 27 and then flown from the cut-out portions 40 into a suction chamber of the discharge-side impeller 24 defined by the guide blades 27 by a partition plate 26. Then, the coolant 3 is directed into the central suction opening of the discharge-side impeller 24 by being guided the return blades 28 that are provided on the discharge side of the return blades 27 to be sucked by the discharge-side impeller 24.

Then, the suctioned coolant 3 is sent in the peripheral direction by the plurality of blades 23 formed on the surface of the discharge-side impeller 24 and is discharged out of the pump 7 from a discharge port 12 provided at a side surface of the pump 7.

The discharged coolant 3 is sent into a cooling device 4 via a pipeline 8 connected to the discharge port 12. In the cooling device 4, heat is transferred from a heating element 1 to the coolant 3, whereby the temperature of the coolant 3 is increased. Then, the coolant is sent to a radiator 5 and cooled by it. The coolant whose temperature is lowered again is then returned into the reserve tank 6.

By employing the above-described system, it is possible to cool the heating element 1 by circulating the coolant 3 with the pump 7.

As described above in accordance with the second embodiment, the return blades 28 form concave flow paths 33 with the plurality of thick ribs 32 in the space between the suction-side impeller 25 and the partition plate 26, and the total cross sectional area of inlet openings 34 of the concave paths 33 is set to be equal to or larger than the cross sectional area of the suction port 11, while the total volume of the concave paths 33 is set to be smaller than the total volume of convex non-path portions 35. By this configuration, a sudden expansion of the flow paths from the upstream side toward the downstream side of the return blades 28 can be avoided, thereby allowing a smooth liquid flow.

Accordingly, in accordance with the second embodiment, it is possible to provide a highly efficient high-lift pump having a small liquid volume, which suffers little fluid loss by the return blades 28.

Further, by making the center-side leading ends 36 of the return blades 28 adjoined to the suction opening of the next-stage impeller 24, a vortex current is created when liquid flows into the suction opening 37 of the next-stage impeller 24.

Accordingly, in accordance with the second embodiment, when the liquid is guided by the return blade 28 to flow into the suction opening 37 of the next-stage impeller 24, it is possible for the flow to be smooth.

Figure 4:
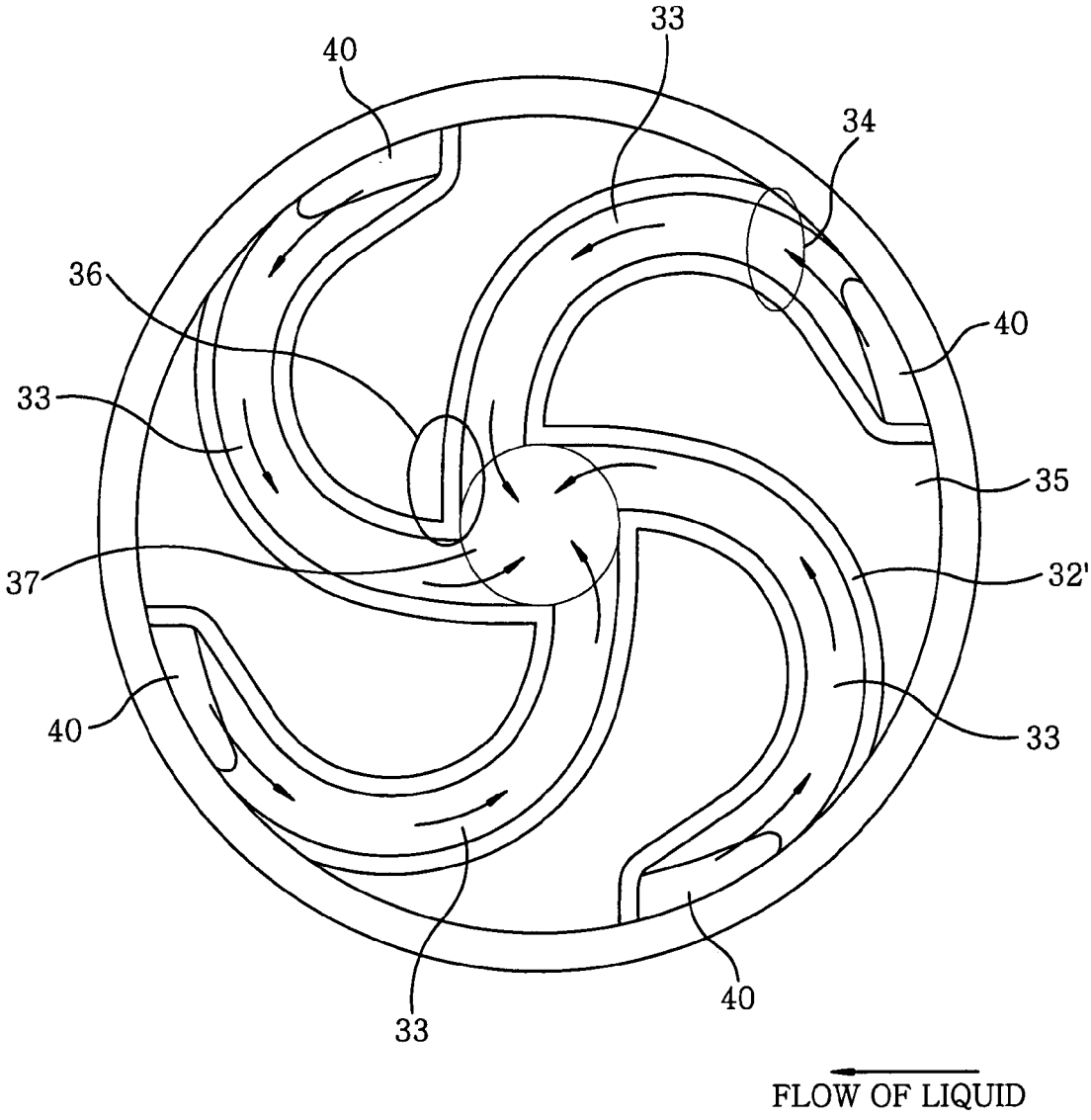
FIG. 4 presents a plan view of return blades which form non-path portions with thin ribs in accordance with the first and the second embodiment of the present invention.
Figure 5A:
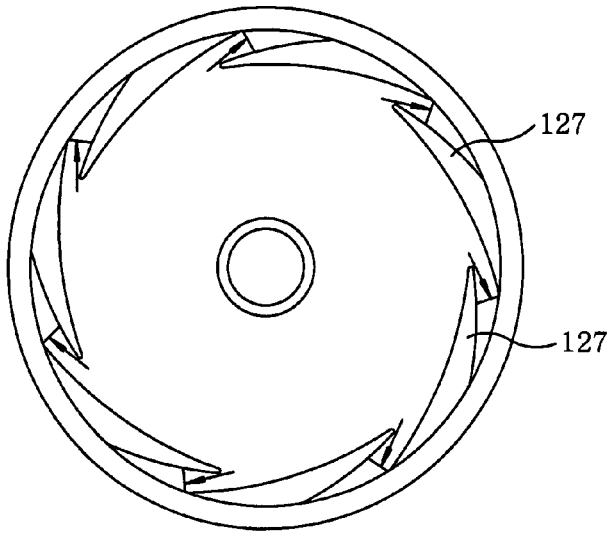
FIG. 5A (PRIOR ART)
FIGS. 5A to 5C show conventional guide blades and return blades.
Figure 5B:
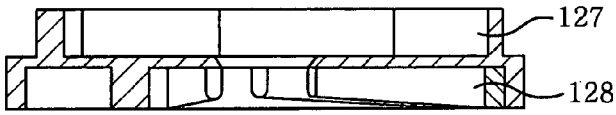
FIG. 5B (PRIOR ART)
Figure 5C:
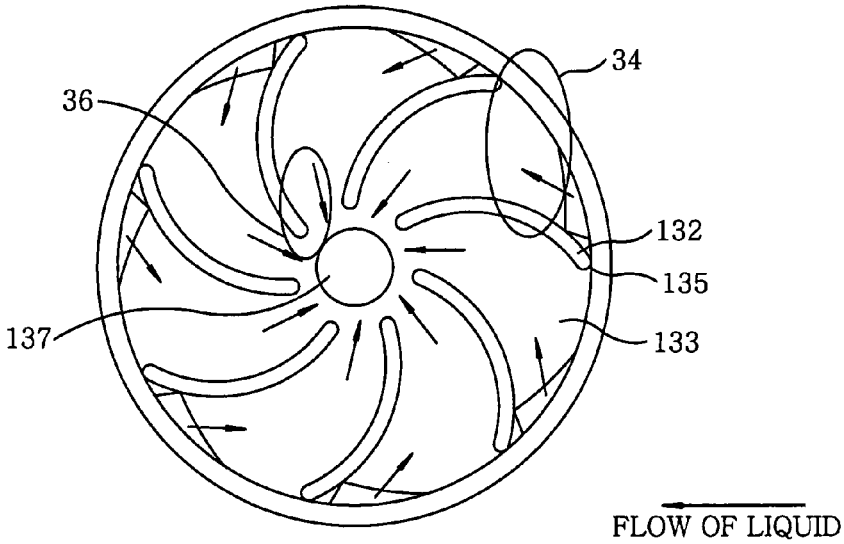
FIG. 5C (PRIOR ART)

Further, in the first and the second embodiment of the present invention, although the non-path portions of the return blades 28 are formed by convex thick ribs, the same effect can be obtained by forming the non-path portions with thin ribs 32' as illustrated in FIG. 4.

Moreover, although the cooling device for electronic components is exemplified as a liquid supply system in the first and the second embodiment of the present invention, the present invention may be applied to any liquid supply system such as a well pump device, a hot water supply system or a drain water supply system.

The present invention may also be applied to various other pumps for use in, e.g., a fuel battery device, a heat pump device and the like.

While the invention has been shown and described with respect to the embodiment, it will be understood by those skilled in the art that various changes and modifications may be made without departing from the scope of the invention as defined in the following claims.

What is claimed is:

1. A pump comprising:

a pump unit including at least two impellers for sucking and discharging a liquid, the impellers being disposed in multiple stages;

a pump case accommodating the pump unit and provided with a suction port and a discharge port for the liquid;

a motor unit for driving the pump unit;

a plurality of guide blades forming plural guide paths in tangent directions of the impellers; and a multiplicity of return blades radially disposed between the impellers to form paths for collecting the liquid under pressure from the guide paths into a suction opening of a next-stage impeller, wherein the return blades have a configuration in which a total cross sectional area of inlet openings of concave paths formed by a plurality of ribs is set to be equal to or larger than a cross sectional area of the suction port, while a total volume of the concave paths is set to be smaller than the total volume of non-path portions excluding the paths.

2. The pump of claim 1, wherein center-side leading ends of the return blades are adjoined to the suction opening of the next-stage impeller.

3. A liquid supply system comprising the pump described in claim 1.

4. A liquid supply system comprising the pump described in claim 2.

* * * * *